US011534821B2

(12) United States Patent
Izawa et al.

(10) Patent No.: US 11,534,821 B2
(45) Date of Patent: Dec. 27, 2022

(54) CONTINUOUS CASTING METHOD FOR STEEL AND REDUCTION ROLL FOR CONTINUOUS CASTING

(71) Applicant: NIPPON STEEL CORPORATION, Tokyo (JP)

(72) Inventors: Kenichiro Izawa, Tokyo (JP); Kenji Taguchi, Tokyo (JP); Ryo Nishioka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/971,607

(22) PCT Filed: Mar. 6, 2019

(86) PCT No.: PCT/JP2019/008806

§ 371 (c)(1),
(2) Date: Aug. 20, 2020

(87) PCT Pub. No.: WO2019/172302

PCT Pub. Date: Sep. 12, 2019

(65) Prior Publication Data

US 2020/0391282 A1 Dec. 17, 2020

(30) Foreign Application Priority Data

Mar. 8, 2018 (JP) ..... JP2018-041620

(51) Int. Cl.
*B22D 11/128* (2006.01)
*B22D 11/20* (2006.01)

(52) U.S. Cl.
CPC ..... *B22D 11/1287* (2013.01); *B22D 11/20* (2013.01)

(58) Field of Classification Search
CPC .... B22D 11/128; B22D 11/1287; B22D 11/20
USPC ..... 164/476, 417
See application file for complete search history.

(56) References Cited

FOREIGN PATENT DOCUMENTS

| | | | |
|---|---|---|---|
| CN | 104399924 | A | 3/2015 |
| JP | 60-162560 | A | 8/1985 |
| JP | 2-56982 | B2 | 12/1990 |
| JP | 2000-107844 | A | 4/2000 |
| JP | 2003-94154 | A | 4/2003 |
| JP | 2004-58129 | A | 2/2004 |
| JP | 2009-279652 | A | 12/2009 |

*Primary Examiner* — Kevin P Kerns
(74) *Attorney, Agent, or Firm* — Birch, Stewart, Kolasch & Birch, LLP

(57) ABSTRACT

A continuous casting method for steel in which a slab at a position where the center solid phase rate of the slab is 0.8 or more and including after complete solidification is reduced by a reduction roll. The roll outer peripheral shape in a cross-section including a roll rotation axis convex shape overhanging outward in a region including a width-direction center position of the slab. The convex shape is a shape that does not have corner portions in a convex shape defining range with a total length of 0.80×W on both sides in the roll width direction from the width-direction center position. A reduction roll radius at the width-direction center position is greater by 0.005×t or more than a reduction roll radius at both ends of the convex shape defining range.

6 Claims, 5 Drawing Sheets

CONTINUOUS CASTING METHOD FOR STEEL AND REDUCTION ROLL FOR CONTINUOUS CASTING

TECHNICAL FIELD OF THE INVENTION

The present invention relates to a continuous casting method for steel and a reduction roll for continuous casting.

Priority is claimed on Japanese Patent Application No. 2018-041620 filed on Mar. 8, 2018, the content of which is incorporated herein by reference.

RELATED ART

In a case where cast slabs such slabs and blooms are cast by a continuous casting method, so-called center segregation in which components such as phosphorus and manganese segregate at a center portion of the slab may occur. Additionally, holes referred to as center porosity are generated at the center portion of the cast slab.

In the last stage of solidification during continuous casting, the amount of steel occupying a predetermined volume within the slab becomes insufficient due to solidification shrinkage when steel is solidified. In a slab part where unsolidified molten steel can flow, the unsolidified molten steel flows toward a solidification completion point of a final solidified portion, and impurity-enriched molten steel at a solid-liquid interface accumulates in the final solidified portion, which causes center segregation. Additionally, at a position where the unsolidified molten steel cannot flow (the slab center solid phase rate is 0.8 or more), voids are formed at a center portion of the slab, which causes center porosity.

In order to decrease the center segregation, by reducing a solidified shell by the amount corresponding to the amount of solidification shrinkage of the molten steel in a region where the thickness center is a solid-liquid coexistence region and the unsolidified molten steel can flow, it is effective to suppress the flow of the molten steel in the vicinity of the final solidified portion. Additionally, in order to decrease the center porosity, it is effective to compress the center porosity by reducing the slab in the vicinity of the solidification completion position where the unsolidified molten steel cannot flow or after the complete solidification. A light reduction technique of reducing the slab by a support roll before and after the completion of solidification at the last stage of the continuous casting is used on the basis of such a concept.

When trying to reduce the slab before and after the solidification is completed during the continuous casting, the deformation resistance associated with the reduction is large because both short sides of the slab have already been solidified and the temperature has been lowered. In some cases, a predetermined reduction amount cannot be obtained. Thus, instead of using a roll (hereinafter referred to as a "flat roll") in which the diameter of the roll is constant in the roll width direction, a technique was developed using a roll (hereinafter referred to as a "convex roll") having a shape in which the roll diameter of a portion corresponding to a width central portion of the slab is large and the roll diameter of portions corresponding to both sides of the slab width is smaller than that of the width central portion, the technique reducing only the width central portion of the slab without reducing both short sides on which the solidification of the slab is completed.

Patent Document 1 describes that the occurrence of the center segregation can be decreased by using a convex crown (planar) roll having a convex plane width of 200 mm to 240 mm to apply a reduction to an unsolidified slab, thereby performing a reduction of 0.5 mm to 10.0 mm per stage. However, in this invention, it is premised that an unsolidified portion remains inside the slab, and required facility requirements tend to be too small. Additionally, since the main purpose is to compensate for the cavity in the center portion due to the solidification shrinkage, there is a problem in that the application of the reduction to the center portion of the slab is not sufficiently optimized.

Moreover, if the reduction amount under light reduction in an unsolidified region is increased, there is a problem of internal cracking and a problem of occurrence of inverted V segregation. Therefore, the amount of the light reduction is formed to reduced, which is insufficient for reducing the center porosity.

Patent Document 2 discloses, as a roll reduction method for reducing center porosity, a continuous casting method in which a region which, after a slab is completely solidified and before cutting thereof, the surface temperature of the slab is 700° C. or higher and 1000° C. or lower and a temperature difference between the inner center and the surface of the slab is 250° C. or higher is sandwiched and reduced between rotating upper and lower rolls. At a reduction part, an inner portion is relatively softer than a surface layer due to high temperature, so that a reduction force applied to the surface of the slab can be transmitted to the inside of the slab. A convex roll used as a reduction roll has a protruding region for reduction including a horizontal portion at the center in a width direction and inclined portions connected to the horizontal portion on both sides of the horizontal portion. The width of the horizontal portion (reduction width) is preferably 40% or less of the slab width. The reduction amount is preferably 2% or more of the thickness of the slab.

Patent Document 3 discloses a continuous casting method in which at least one crown roll is provided as a reduction roll, and a central portion of a slab and its vicinity are reduced. The slab is reduced by the crown roll within a region where the generation rate of a solidified shell of the slab is 75% or more, and concentrated molten steel in a reduced internal unsolidified portion is pushed upward and eliminated. The shape of the crown may be any shape as long as the central portion in the width direction of the slab and the vicinity thereof can be reduced, and a reduction roll having a shape in which a center portion in the roll width direction bulges outward is illustrated in a drawing. The reduction amount per stage is set to a maximum of 3 mm.

PRIOR ART DOCUMENT

Patent Document

[Patent Document 1] Japanese Unexamined Patent Application, First Publication No. 2003-94154

[Patent Document 2] Japanese Unexamined Patent Application, First Publication No. 2009-279652

[Patent Document 3] Japanese Unexamined Patent Application, First Publication No. S60-162560

DISCLOSURE OF THE INVENTION

Problems to be Solved by the Invention

In a case where the slab is reduced during the continuous casting, particularly in a case where the slab is reduced after the solidification is completed, the reduction of a portion where the reduction resistance at both ends of the slab width is large is not performed by using the convex roll instead of the flat roll as the reduction roll. For this reason, the reduction force of the reduction roll for realizing the reduction can be decreased. However, even if a related-art convex roll is used, if a sufficient reduction is to be performed in order to realize center porosity decrease, the required reduction force becomes excessively large, and large-scale facility enhancement is required to secure the reduction force. Additionally, as a result of performing reduction using the convex roll, a dent is formed on the surface of the slab after the continuous casting, and this dent causes a defect in hot rolling in a post-step.

An object of the present invention is to provide a continuous casting method for steel and a reduction roll for continuous casting that can decrease the center porosity of a continuous cast slab without performing large-scale facility enhancement and can also decrease the generation of defects in hot rolling that is a post-step.

Means for Solving the Problem

That is, the gist of the present invention is as follows.

(1) A continuous casting method for steel according to a first aspect of the present invention is a continuous casting method for steel in which a slab at a position at which a center solid phase rate of the slab is 0.8 or more and which includes after complete solidification, is reduced by at least one pair of reduction rolls during continuous casting, a slab width to be cast is defined as W (mm) and a slab thickness is defined as t (mm), for at least one of the pair of reduction rolls, a roll outer peripheral shape in a cross-section including a roll rotation axis has a convex shape overhanging outward in a region including a width-direction center position of the slab, the convex shape is any one of a curved shape that is convex outward and has no corner portion or a shape that is a combination of a curve that is convex outward and a straight line with a length within 0.25×W and that has no corner portion, in a convex shape defining range of a total length of 0.80×W on both sides in a roll width direction from the width-direction center position, and a reduction roll radius at the width-direction center position is greater by 0.005×t or more than a reduction roll radius at both ends of the convex shape defining range.

(2) In the above (1), a position of the slab in a casting direction in which the reduction is performed by the reduction roll may be a position after the complete solidification.

(3) In the above (1) or (2), a reduction amount of the slab by the pair of reduction rolls may be 0.005×t or more and 15 mm or less at the width-direction center position.

(4) A reduction roll for continuous casting according to a second aspect of the present invention is a reduction roll for reducing a slab having a slab width: W (mm) and a slab thickness: t (mm) during continuous casting, a roll outer peripheral shape in a cross-section including a roll rotation axis has a convex shape overhanging outward in a region including a width-direction center position of the slab, the convex shape is any one of a curved shape that is convex outward and has no corner portion or a shape that is a combination of a curve that is convex outward and a straight line with a length within 0.25×W and that has no corner portion, in a convex shape defining range of a distance of 0.80×W on both sides in a roll width direction from the width-direction center position, and a reduction roll radius at the width-direction center position is greater by 0.005×t or more than a reduction roll radius at both ends of the convex shape defining range.

(5) In the above (4), the roll outer peripheral shape may have a straight line parallel to the roll rotation axis at both ends in the width direction, and may have a concave curve that is smoothly connected to the straight line and is concave outward.

Effects of the Invention

By using the convex curved roll of the present invention as a reduction roll when the slab after the complete solidification during the continuous casting is reduced, the center porosity can be reduced by performing sufficient reduction with a small reduction amount and defects in the hot rolling resulting from the slab reduction shape can be reduced.

EMBODIMENTS OF THE INVENTION

A first embodiment and a second embodiment will be described with reference to FIGS. 1 to 8.

Figure 4:
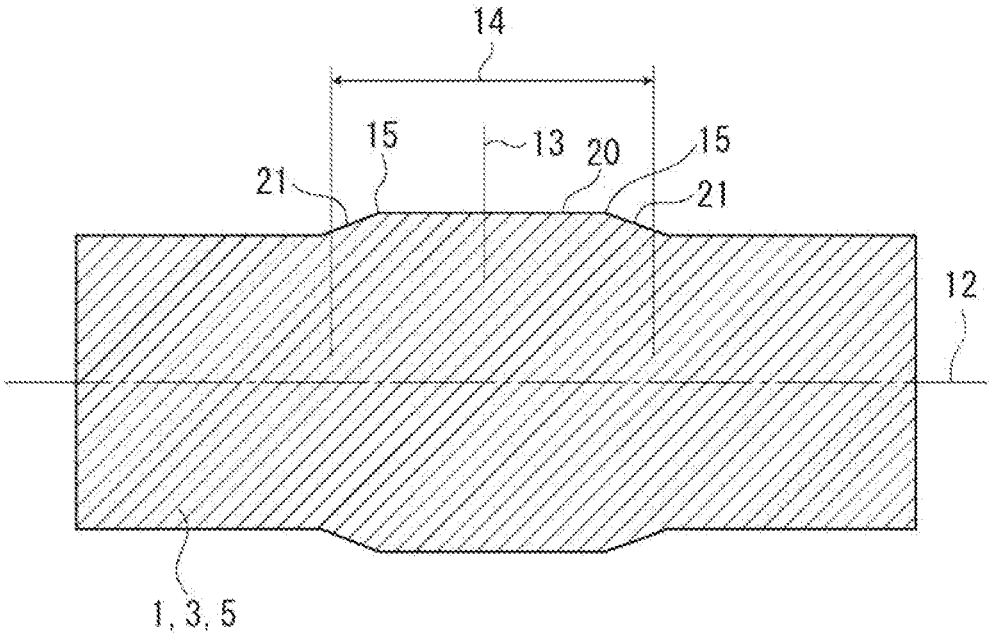
FIG. 4 RELATED ART
FIG. 4 is a cross-sectional view of a related-art reduction roll.

In order to continuously cast a slab 10 as a raw material for manufacturing a steel product for a strip, bloom continuous casting or billet continuous casting is applied. In the bloom continuous casting, the cast slab 10 has an oblong cross-sectional shape, for example, a slab having a width of 500 mm and a thickness of 300 mm is cast. In a case where such a slab 10 having an oblong cross-section is cast, an unsolidified portion of the slab 10 extends over a range of "slab width-slab thickness" in total on both sides in a width direction from the width-direction center position of the slab in at a position immediately before a thickness central portion of the slab 10 is completely solidified, and center porosity also occurs in this region. For that reason, even in a case where the cast slab 10 is reduced by using a convex roll 3 as a center porosity countermeasure, as illustrated in FIG. 4, in the related art, a roll having a horizontal portion 20 having at a width-direction center position (hereinafter, may be referred to as a width center position) 13 of the slab 10 (not illustrated) has been used as the convex roll 3 in order to reliably reduce the above center porosity generation region. Inclined portions 21 are provided on both sides of the horizontal portion 20 in the width direction, and a joint position between the horizontal portion 20 and each inclined portion 21 constitutes a corner portion 15. In addition, the term "complete solidification" refers to a state in which the solid phase rate determined by the ratio of solid and liquid has reached 1.0 and no liquid phase is present, and the temperature is equal to or lower than a solidus temperature TS. In other words, the complete solidification is a state in which the temperature is lower than TS at any point on a C cross-section (a cross-section perpendicular to a rolling direction). The fact that the slab is completely solidified can be confirmed by actually measuring the surface or internal temperature of the slab at several points and correcting the estimated solid phase rate calculated from the temperature distribution estimated by the heat transfer calculation. Additionally, in a case where a stud is driven into the slab and components of the stud are diffused into the remaining liquid phase, the shape of a solidified shell can be estimated, it can be confirmed that the slab is not completely solidified, and in a case where the stud keeps its original shape, it can be confirmed that the slab is completely solidified.

Figure 1:
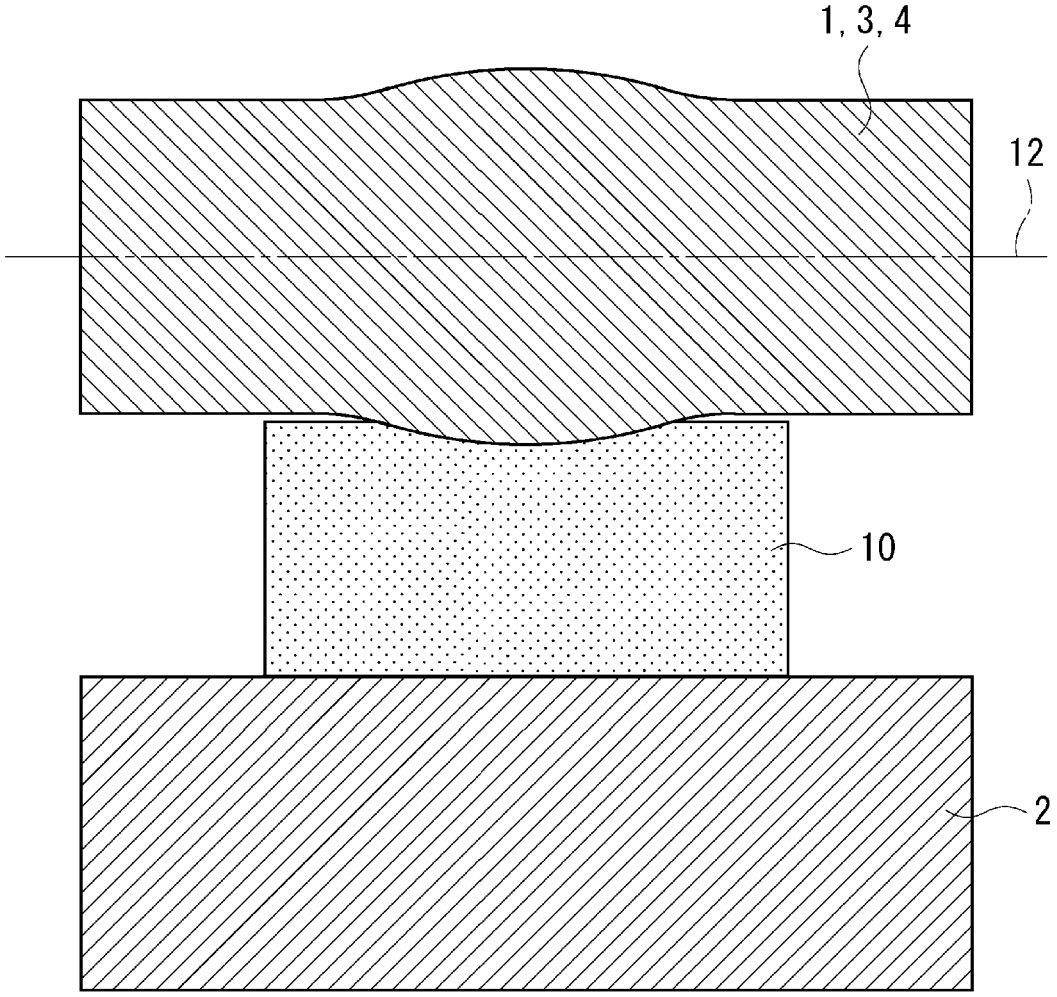
FIG. 1 is a cross-sectional view illustrating a situation where a slab is reduced by a reduction roll according to a first embodiment.
Figure 2:
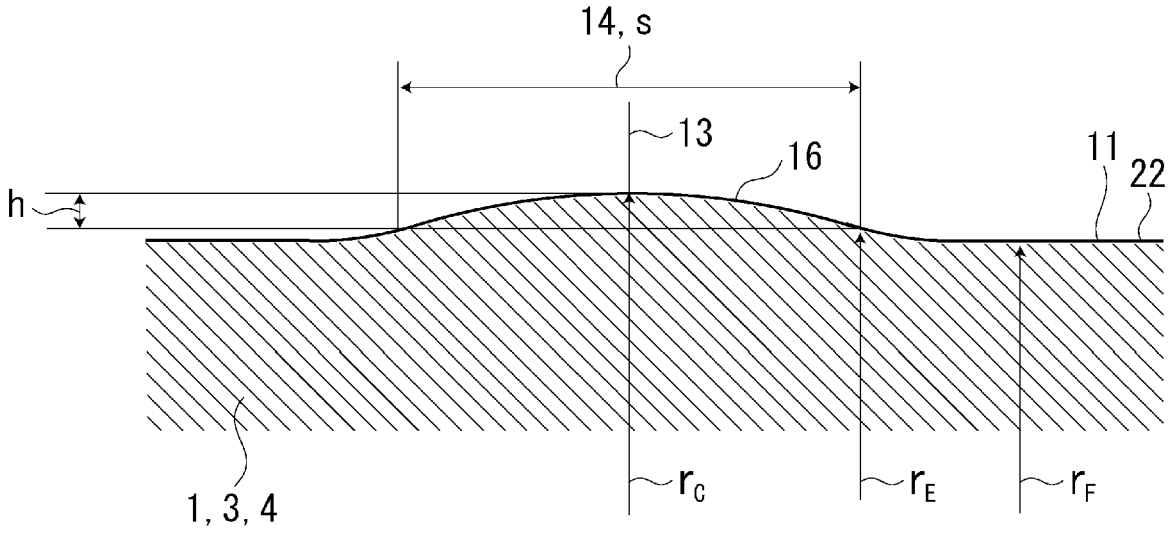
FIG. 2 is a partial cross-sectional view of the reduction roll according to the first embodiment.
Figure 3:
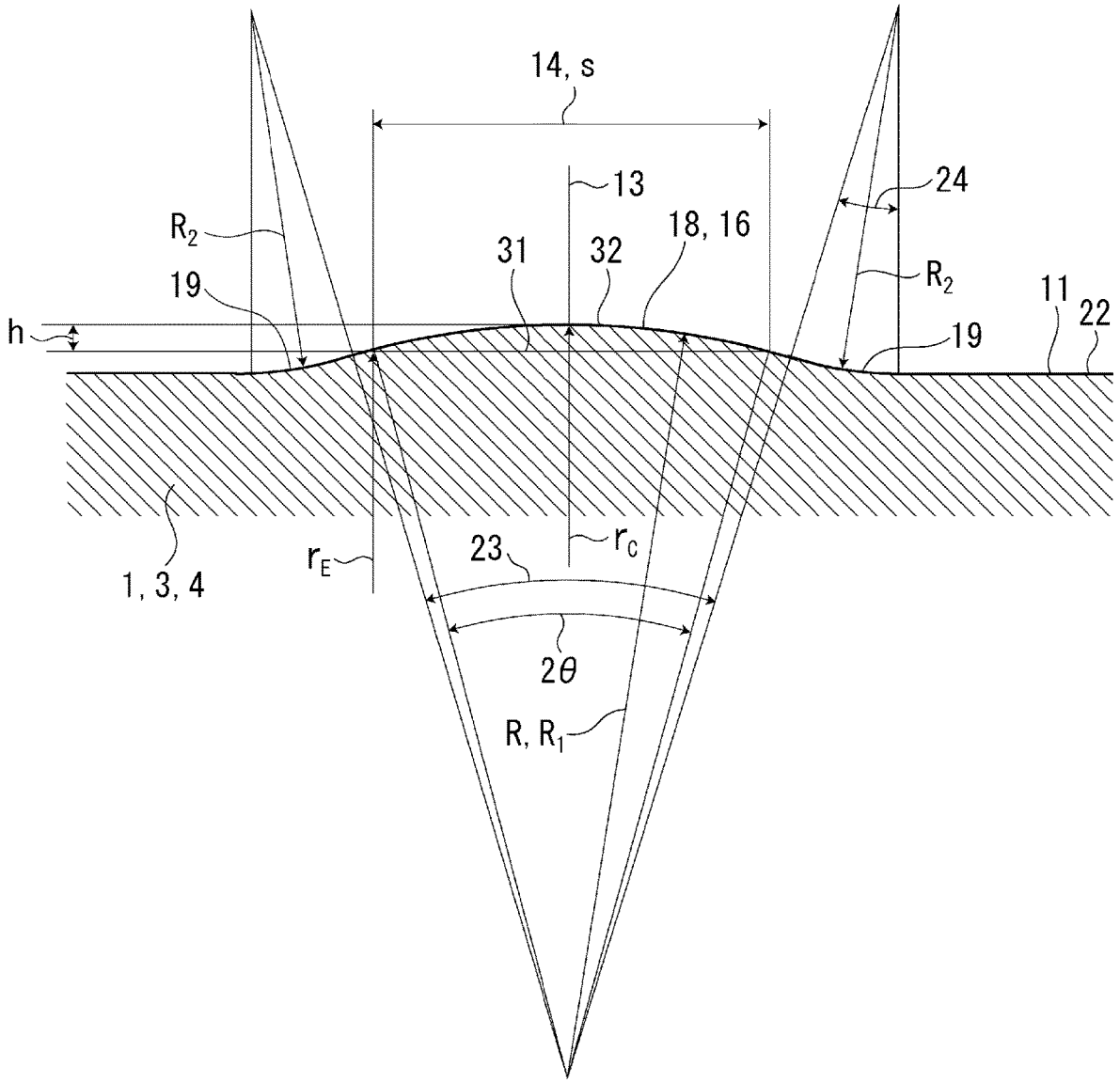
FIG. 3 is a detailed partial cross-sectional view of the reduction roll according to the first embodiment.

The inventor of the present invention has conceived that the convex roll 3 for reducing the slab 10 forming a roll outer peripheral shape 11, which is a portion where an outer circumferential surface of the convex roll 3 and a cross-section including a roll rotation axis 12 intersect each other, into a curved shape that is convex outward and has no corner portion as illustrated in FIGS. 1 to 3, not forming a shape with the horizontal portion 20-the corner portion 15-the inclined portion 21 as illustrated in the related-art FIG. 4 allows the center porosity of the slab 10 being reliably decreased, the reduction force required for the reduction being decreased, and the generation of defects in hot rolling that is a post-step being decreased. Hereinafter, the convex roll 3 having the horizontal portion 20-the corner portion 15-the inclined portion 21 is referred to as a "convex disc roll 5", and the convex roll 3, which is convex outward and forms a curved shape having no corner portions, is referred to as a "convex curved roll 4". In addition, "having the corner portion" means that a location where the second-order differential value of a function (the rate of change of the slope of a tangent of the function) defining the roll outer peripheral shape is substantially larger than the second-order differential value of a function defined by an arc having a radius of 10 mm can be considered as being present. The term "smoothly connected" can be defined as having an inflection point where the second-order differential value of the function defining the roll outer peripheral shape is 0, and the second-order differential value is continuous before and after the inflection point.

First, by deformation analysis using the finite element method, the deformation behavior was determined for how a slab surface and a slab thickness central portion are deformed when the slab 10 during continuous casting with the same reduction force was reduced using the convex disc roll 5 and the convex curved roll 4. The slab 10 to be continuously cast has a width W of 550 mm, and the aspect ratio (width/thickness) of the slab 10 is 1.3. As illustrated in FIG. 4, the convex disc roll 5 has a horizontal portion 20 having a width of 0.4×W at the center of a width direction and is provided with inclined portions 21 having an inclination of 17° on both sides of the horizontal portion 20. As illustrated in FIG. 3, in the convex curved roll 4, the roll outer peripheral shape 11 in a cross-section passing through the roll rotation axis 12 is an arc shape 18 having an arc radius $R_1$ of 0.8×W. In both the convex rolls 3, a roll radius $r_C$ at the width center position 13 is 0.8×W The convex disc roll 5 is in contact with the slab 10 only at the horizontal portion 20 and each inclined portion 21 up to a reduction amount of 10 mm. The convex curved roll 4 is in contact with the slab 10 only in an arc shape 18 up to a reduction amount of 10 mm. As illustrated in FIG. 1, in the pair of reduction rolls (a pair of reduction rolls 1 and 2), the reduction roll 2 on an F side (lower side) is a flat roll, and the convex roll 3 is used for the reduction roll 1 on an L side (upper side).

As the internal temperature distribution of the slab at the position where the reduction was performed, the temperature distribution at a position 3 minutes (10 m) after a position where the complete solidification was performed was set. The width-direction range of a final solidified portion is a range of 0.2×W, and this range is a center porosity generation region. The slab surface temperature was 850° C., and the temperature at a thickness center portion and a width center portion was 1400° C.

A reduction force was applied to each of the convex disc roll 5 and the convex curved roll 4 with a reduction force of 100 tons (980.665 kN), and deformation analysis was performed by the finite element method. As a result of the deformation analysis, the reduction amount (mm) of the slab surface and the plastic strain (standardized equivalent plastic strain) at the thickness center portion of the slab 10 were analyzed. The dimension in the slab width direction was standardized such that the width central portion was an origin and W/2 was 1, and was indicated by x.

The equivalent plastic strain is defined as $\varepsilon^B$ in (Equation 1) from plastic strains ($\varepsilon_1^P$, $\varepsilon_2^P$, $\varepsilon_3^P$) in an uniaxial direction, and is a scalar quantity obtained by converting strains in three-dimensional deformation into uniaxial deformation. This analysis is based on the idea that the greater the strain, the greater the amount of internal deformation due to the reduction, and the greater the porosity decrease effect. For this reason, the equivalent plastic strain was calculated for each mesh of an analysis model, and the amount of deformation of the thickness center portion was output for each roll shape to evaluate the reduction efficiency. Moreover the standardized equivalent plastic strain is a value obtained by standardizing the equivalent plastic strain $\varepsilon^B$ such that the value of the equivalent plastic strain at the width center position 13 when reduced by using the convex disc roll is 1.

$$\varepsilon^B=\sqrt{[(2/3)\{(\varepsilon_1^P)^2+\varepsilon_2^P)^2+(\varepsilon_3^P)^2\}]} \quad \text{(Equation 1)}$$

Figure 5:
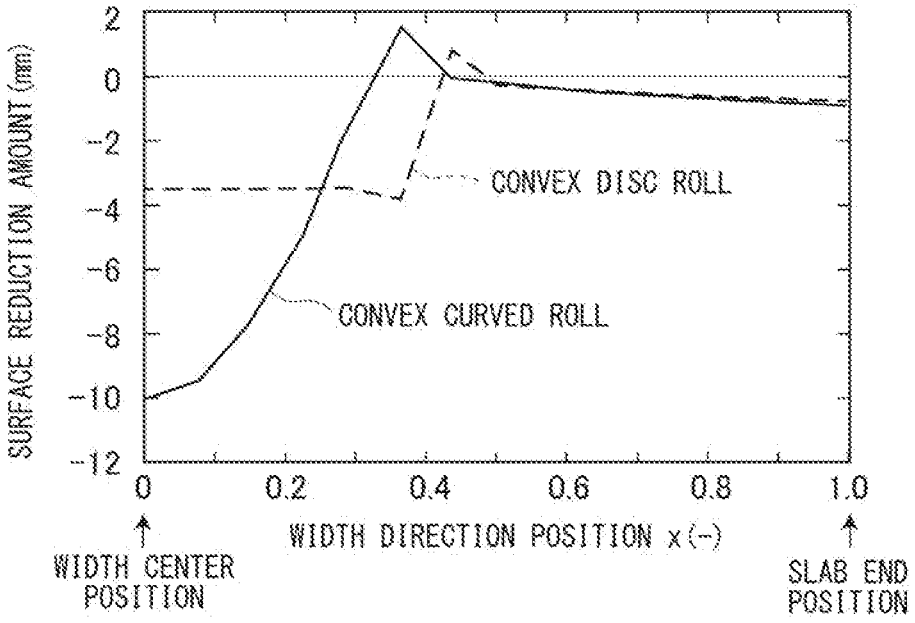
FIG. 5 is a graph illustrating the first embodiment, and is a graph illustrating a width-direction distribution of a slab surface reduction amount obtained by deformation analysis by the finite element method.

FIG. 5 is a graph illustrating the width-direction distribution of the slab surface reduction amount obtained by the deformation analysis of the finite element method. As illustrated in FIG. 5, irrespective of the application of the same reduction force of 100 tons, the surface reduction amount at the width center position 13 was about 4 mm for the convex disc roll 5 and about 9 mm for the convex curved roll 4. On the other hand, as the distance from the width center position 13 increases, the reduction amount of the convex disc roll 5 is constant, whereas the reduction amount of the convex curved roll 4 decreases, the surface reduction amount becomes the same in the vicinity of the distance x=0.3 from the width center position 13, and the reduction amount of the convex disc roll 5 becomes larger up to x=0.4 from the outside. Each of the convex disc roll 5 and the convex curved roll 4 realizes a surface reduction amount according to the outer shape of each roll.

Figure 6:
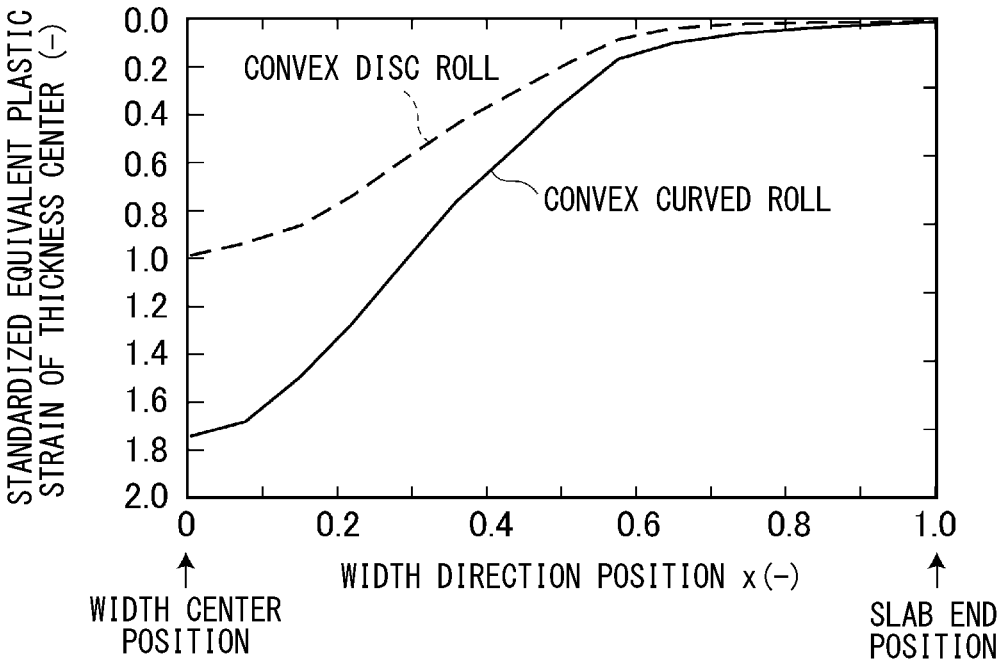
FIG. 6 is a graph illustrating the first embodiment, and is a graph illustrating a width-direction distribution of standardized equivalent plastic strain at the center of the thickness of the slab obtained by deformation analysis by the finite element method.

FIG. 6 is a graph illustrating the width-direction distribution of the standardized equivalent plastic strain at the center of the thickness of the slab obtained by the deformation analysis of the finite element method. As illustrated in FIG. 6, surprisingly, the value of the standardized equivalent plastic strain is larger in the convex curved roll 4 than in the convex disc roll 5 over the entire region in the width direction. As for the width center position 13, since the surface reduction amount is larger in the case of the convex curved roll 4, it is as expected that the standardized equivalent plastic strain in the thickness center portion also has a large value. On the other hand, in a region exceeding the distance x=0.3 from the width center position 13, the convex disc roll 5 is larger in the surface reduction amount. Therefore, the standardized equivalent plastic strain at the thickness center portion is also expected to be larger in the convex disc roll 5. However, in the deformation analysis by the finite element method, contrary to the expectation, the result was that the standardized equivalent plastic strain at the thickness center portion is larger in the convex curved roll 4 to width-direction ends.

From the results of the deformation analysis by the finite element method described above, if the same reduction force is used in order to decrease the center porosity by the reduction using the convex roll 3 in the actual continuous casting, it was suggested that the improvement effect would be greater when the convex curved roll 4 was used as the reduction roll 1 than when the convex disc roll 5 was used.

Thus, in the actual continuous casting, a comparison was made of the effect of decreasing the center porosity of the slab 10 when each of the convex disc roll 5 and the convex curved roll 4 was used as the reduction roll 1 for continuous casting. The aspect ratio (width/thickness) of the slab 10 to be cast is 1.3. The width of the slab 10 is W (mm). As the reduction roll 1, the convex disc roll 5 has the horizontal portion 20 having a width of 0.4×W at the center of a width direction and is provided with inclined portions 21 having an inclination of 17° on both sides of the horizontal portion 20. In the convex curved roll 4, the roll outer peripheral shape 11 in a cross-section passing through the roll rotation axis 12 is the arc shape 18 having the arc radius $R_1$ of 0.8×W In both the convex rolls 3, the roll radius $r_C$ at the width center position 13 is 0.8×W. Additionally, in both the convex rolls 3, a roll radius $r_F$ at flat portions on both sides of the width is 0.65×W In both cases, a flat roll is used as the roll 2 on the F side of the reduction roll pair.

During the continuous casting, a reduction force of 100 tons was applied to a reduction roll at a position (10 m) 3 minutes after the final solidification position, and the slab 10 was reduced. The surface shape of the cast slab 10 and the center porosity generation situation of the thickness central portion of the slab were evaluated.

On the upper surface side of the cast slab 10, a dent resulting from a protrusion of each convex roll 3 was formed. Comparing the thickness of both ends of the width of the slab 10 with the thickness of the width central portion, the amount of indentation by the convex disc roll 5 was about 4 mm, and the amount of indentation by the convex curved roll 4 was about 9 mm. Each of the indentation shapes was a shape following the outer shape of the convex roll 3.

The center porosity of the slab 10 was evaluated using the porosity area ratio calculated by color check of the cross-section of the slab as an index. As a result, the results were obtained in which the porosity area ratio of the convex disc roll was 3%, and the porosity area ratio of the convex curved roll 4 was 0.3%. The effect of improving the center porosity by using the convex curved roll 4 is apparent.

As described above, when the slab 10 is reduced by the reduction roll during the continuous casting, the convex curved roll 4 according to the first embodiment is used as the reduction roll. Accordingly, it became apparent that the center porosity improvement effect was superior to the case of using the convex disc roll 5 under the same reduction force. Additionally, in a case where the center porosity improvement effect was made the same, it also became apparent that the convex curved roll 4 can obtain the same effect with a smaller reduction force than the convex disc roll.

Next, requirements that the convex curved roll 4, which is the reduction roll 1 according to the present embodiment should have will be described below in order of the first embodiment and the second embodiment.

The first embodiment will be described with reference to FIGS. 1 to 3. In the reduction roll 1, the roll outer peripheral shape 11 in a cross-section passing through the roll rotation axis 12 has the following shape. First, the roll outer peripheral shape 11 forms a convex shape that overhangs outward in a region including the width-direction center position (width center position 13) of the slab 10. The outside is a direction in which the outer periphery of the roll moves away from the roll rotation axis 12. By forming such a shape, the roll radius $r_C$ is maximum at the width center position 13, and the reduction amount of the slab surface when the slab 10 is reduced is maximum at the width center position 13. Next, a range of a total length of 0.80×W on both sides in the roll width direction from the width center position 13 is defined as the "convex shape defining range 14". It is characterized in that, since both ends of the width of the slab 10 have a large deformation resistance when the slab 10 is reduced using the convex roll 3, the reduction is not performed. If the slab 10 is reduced in the convex shape defining range 14 or a width smaller than this, the reduction force required for the reduction can be suppressed to be low while securing a required reduction amount. For that reason, if the convex shape of the reduction roll 1 is defined within the convex shape defining range 14, an excellent reduction can be performed according to the first embodiment. The convex shape within the convex shape defining range 14 is a curved shape that is convex outward and has no corner portion. The term "convex outward" means being convex in a direction away from the roll rotation axis 12. Moreover, the thickness of the slab 10 to be cast is t (mm), and the roll radius $r_C$ at the width center position 13 is 0.005×t or more larger than a reduction roll radius $r_E$; at both ends of the convex shape defining range 14. Accordingly, when the slab 10 is reduced by the reduction roll 1, if the entire convex shape defining range 14 of the reduction roll 1 is configured to reduce the slab 10, the reduction amount of the slab 10 at the width center position 13 can be 0.005×t or more. It is more preferable that the roll radius $r_C$ at the width center position 13 is larger by 0.010×t or more.

As the simplest and most effective shape among the convex shapes within the convex shape defining range 14, the arc shape 18 having a single arc radius $R_1$ can be used as illustrated in FIG. 3. In this case, the roll outer peripheral shape 11 within the convex shape defining range 14 forms an arcuate shape in which the length portion of the convex shape defining range 14 is a chord 31. When the length (the length of the chord 31) of the convex shape defining range 14 is s, the radius of the arcuate shape is R, and the height (a difference between the reduction roll radius $r_E$ at both ends of the convex shape defining range 14 and the width center position 13 and the roll radius $r_C$) of an arc 32 of the arcuate shape, the following relationship is established. The central angle of the arcuate shape is defined as 2θ.

$$h=R(1-\cos\theta) \quad \text{(Equation 2)}$$

$$s=2R\sin\theta \quad \text{(Equation 3)}$$

From these equations, the following equation is derived.

$$\cos\theta=(s^2-4h^2)/(s^2+4h^2) \quad \text{(Equation 4)}$$

Therefore, first, θ can be determined by determining the targeted s and h and substituting s and h into the above (Equation 4), and R can be determined by substituting θ into (Equation 2) or (Equation 3). For example, in a case where s=150 mm and h=9 mm are targeted, R=316 mm can be derived by substituting into the above equation.

As the convex shape within the convex shape defining range 14, in addition to the arc shape 18 having the single arc radius $R_1$, a parabolic shape, an elliptical shape, a hyperbolic shape, a shape in which arcs having different radii depending on locations are smoothly connected to each other, and the like can be optionally selected. In a curved shape forming a convex shape and having no corner portion, it is preferable that the curvature radius of the curve is at least 1×h or more. Accordingly, the effect of the first embodiment due to the convex shape being a curve can be sufficiently exerted. The minimum curvature radius of the curve is the same in the second embodiment to be described below.

The roll outer peripheral shape 11 on the width-direction end side outside the convex shape defining range 14 of the reduction roll 1 is not particularly defined. Preferably, the roll outer peripheral shape 11 is a linear shape or a curvilinear shape having no corner portion. In a case where the roll shape at both ends in the width direction of the reduction roll 1 is a cylindrical shape (cylindrical configuration) 22 having an outer circumferential surface substantially parallel to the roll rotation axis 12, it is preferable that the roll outer peripheral shape 11 is a smooth shape that is a combination of a straight line and a curve and has no corner portion from the convex shape defining range 14 to the position of the cylindrical shape 22 at both ends in the width direction. In the roll outer peripheral shape 11, a portion that transitions from the position of the cylindrical shape 22 toward the convex shape defining range 14 may be a curve that is concave outward in the direction away from the roll rotation axis 12. In this way, the roll outer peripheral shape 11 has straight lines parallel to the roll rotation axis 12 at both ends in the width direction, and has a curve that is smoothly connected to the straight lines and is concave outward.

As illustrated in FIG. 3, the simplest and most effective shape of the roll outer peripheral shape 11 of the reduction roll 1 is the single arc shape 18 having the single arc radius $R_1$ in the convex shape defining range 14 and a predetermined range (radius $R_1$ range 23) on both sides outside the convex shape defining range 14. Moreover, with respect to radius $R_2$ ranges 24 on both sides thereof, it is possible to adopt an arc shape 19 having a single arc radius $R_2$ that is smoothly connected to the shape that is concave outward and finally smoothly connected to the straight line of the cylindrical shape 22 of the flat roll. Accordingly, since no corner portion is present in any part of the roll outer peripheral shape 11, even in a case where the roll reduction amount of the reduction roll 1 increases, the reduction range of the roll in the width direction exceeds the convex shape defining range 14, and the reduction from the shape defining range 14 to the portions of the outwardly concave curve immediately before being connected to each of the cylindrical shapes 22 at both ends in the width direction is performed, even any part of the slab surface after the reduction can be a smooth surface in which no corner is formed. Moreover, even in a case where the reduction until the cylindrical shape 22 portion of the flat roll come into contact with the slab 10 is performed, any parts of the slab surface after the reduction can be a smooth surface in which no corner is formed. In this way, even if the roll reduction amount is large, any part of the cast slab surface after the reduction can be a smooth surface in which no corner is formed. As a result, it is possible to decrease the generation of rolling defects resulting from the concave shape of the slab 10 generated by rolling with the convex roll 3 in the hot rolling that is a post-step subsequent to continuous casting. The arc radius $R_2$ is preferably 5 mm or more, more preferably 10 mm or more, and even more preferably 100 mm or more, from the viewpoint of decreasing the generation of rolling defects on the slab 10.

If a device capable of controlling the reduction displacement amount to a targeted displacement amount (a device capable of controlling reduction displacement) is used in a reduction control device that performs the reduction control of the reduction roll 1, the reduction amount can be controlled to the value of the above h or less of the reduction roll 1. As a result, the roll surface in contact with the slab 10 during the reduction can be kept within the convex shape defining range 14. Since the convex shape defining range 14 is a curved shape having no corner portion, no dent in which the angle change of a tangent plane is steep is formed even on the slab surface after the reduction, and generation of defects are caused during the hot rolling that is a post-step.

On the other hand, in a case where a device that cannot perform the reduction displacement control is used as the reduction control device, it is preferable to adopt the simplest and effective shape of the roll outer peripheral shape 11 at a position outside the convex shape defining range 14. The roll outer peripheral shape 11 of the rolling roll is a smooth shape having no corner portion in the convex shape defining ranges 14 and any parts on both sides extending to the cylindrical shape 22 portion. For that reason, even if the reduction is performed such that the flat roll portions at both ends of the width come into contact with the slab 10 due to a large reduction force, a shape in which the angle change of a tangent plane that causes defects is steep is formed on the slab surface after the reduction.

Hence, the center porosity can be decreased by performing sufficient reduction with a small reduction amount, and defects in the hot rolling resulting from the slab reduction shape can be decreased.

Figure 7:
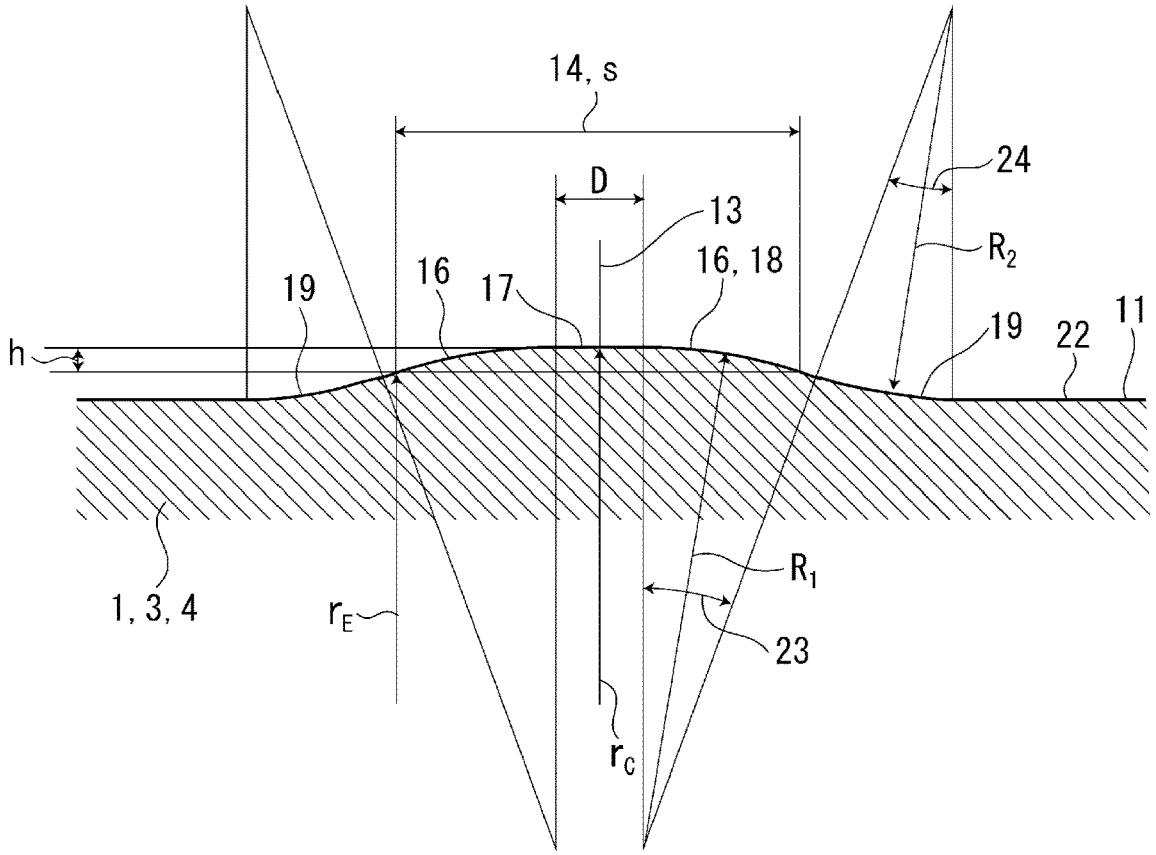
FIG. 7 is a detailed partial cross-sectional view of a reduction roll according to a second embodiment.
Figure 8:
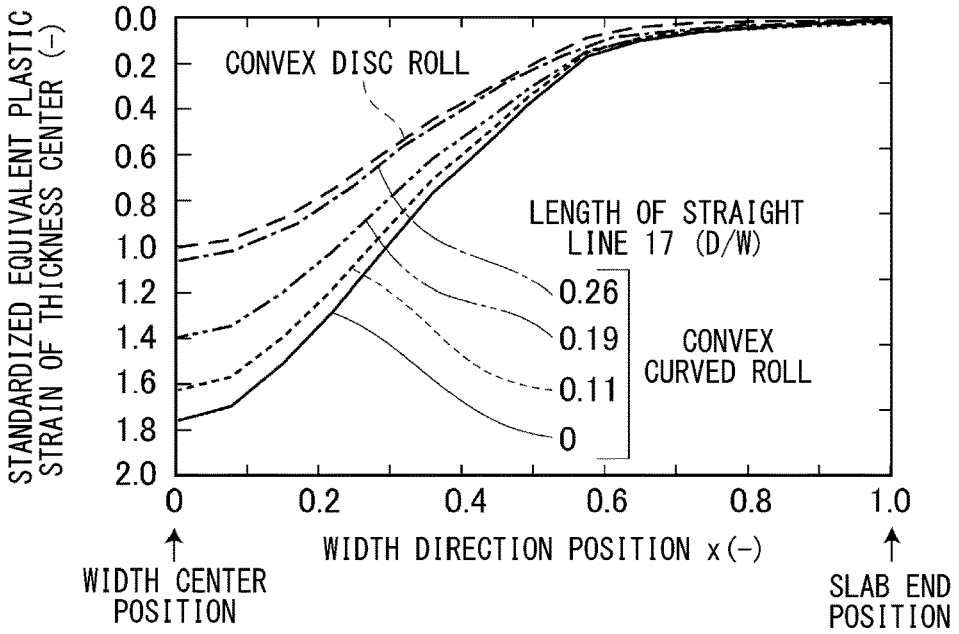
FIG. 8 is a graph illustrating the second embodiment, and is a graph illustrating a width-direction distribution of standardized equivalent plastic strain at the center of the thickness of the slab obtained by deformation analysis by the finite element method.

A second embodiment will be described with reference to FIGS. 7 and 8 as a requirement that the convex curved roll 4 that is the reduction roll 1 according to the present embodiment should have. In the second embodiment, the roll outer peripheral shape 11 in the cross-section including the roll rotation axis 12 of the reduction roll 1 has the following shape. That is, in the first embodiment, the convex shape within the convex shape defining range 14 is defined as a curved shape that is convex outward and has no corner portion. In contrast, in the second embodiment, the convex shape in the convex shape defining range 14 is defined as a shape that is a combination of a curve 16 that is convex outward and a straight line 17 having a length of 0.25×W or less and has no corner portion. Hereinafter, the grounds determined in this way will be described.

The effectiveness of the second embodiment was also confirmed by the deformation analysis using the finite element method. As the roll outer peripheral shape 11, as illustrated in FIG. 7, regarding the combination of the convex curve 16 and the straight line 17, the convex curve was the arc shape 18 having the arc radius $R_1$ of 0.8×W, the straight line 17 was provided as a straight portion having an optional length parallel to a roll axis with the width center position 13 as a center, and the arc shape 18 and the straight line 17 were smoothly connected to each other. After the length of the straight line 17 is set variously, a reduction force was applied with a reduction force of 100 tons, and a deformation analysis was performed by the finite element method. As a result of the deformation analysis, the plastic strain (standardized equivalent plastic strain) at the thickness center portion of the slab 10 was analyzed. FIG. 8 shows the results. A length D of the straight line 17 is represented by D/W in the figure. As D/W increases, that is, as the length D of the straight line 17 increases, the standardized equivalent plastic strain at the thickness center portion decreases in the entire width-direction region. However, if the length D of the straight line 17 is within a range of 0.25×W or less, it was found that the value of the standardized equivalent plastic strain better than that of the convex disc roll 5 can be realized. Thus, such a shape of the reduction roll 1 is the second embodiment.

Hence, the center porosity can be decreased by performing sufficient reduction with a small reduction amount, and defects in the hot rolling resulting from the slab reduction shape can be decreased.

A mechanism by which the convex curved roll 4 according to the second embodiment can have satisfactorily improved the center porosity even with the same reduction force compared to the related-art convex disc roll 5 will be examined. The porosity decrease by the reduction after solidification is due to the fact that the porosity generation region is strained by the reduction and the porosity is compressed. In principle, the amount of strain applied increases as the reduction amount increases. In particular, since the strain of the surface portion directly reflects the push-in amount in the width direction, when the convex curved roll 4 and the related-art convex disc roll 5 are compared with each other and when viewed in the width direction, there is present a location where the convex disc roll 5 exceeds in the amount of strain applied on the slab surface. On the other hand, as the strain permeates the center of the thickness, the strain is also diffused in the width direction. For this reason, since the convex curved roll 4 capable of obtaining a large reduction amount in the curvilinear portion is dominant in the strain amount of the center portion in the thickness direction, it is considered that the analysis result that the convex curved roll 4 is superior over the entire width is obtained.

In the continuous casting method for steel according to the second embodiment, the reduction roll 1 according to the second embodiment is used, and during the continuous casting, the center solid phase rate of the slab 10 is 0.8 or more, and the slab 10 at a position including after the complete solidification is reduced by at least one pair of reduction rolls 1. If the center solid phase rate of the slab 10 is 0.8 or more, a region where the flow of the residual molten steel of the thickness center portion of the slab is difficult is formed. Thus, even if the reduction is performed, a problem of internal cracking and a problem of occurrence of inverted V segregation hardly occur. For at least one of the pair of reduction rolls 1, the reduction roll 1 according to the second embodiment is used. In addition, the center solid phase rate can be defined as the solid phase rate at the center of the C cross-section in the width direction of the slab and at the center in the thickness direction of the slab. The center solid phase rate can be measured by a method of directly measuring the center temperature with a thermocouple, estimation by heat transfer calculation, estimation by tacking, and the like.

It is more preferable that the position of the slab in the casting direction to be reduced by the reduction roll 1 is a position after the complete solidification. By reducing the slab 10 at the position after the complete solidification, the compression of the center porosity can be eliminated without causing the problem of the internal cracking and the problem of the generation of the inverted V segregation. When the slab 10 after the complete solidification is reduced, the reduction position optimal range limit on the downstream side of the casting is a region where the width center surface temperature is 650° C. or higher. This is because, if the width center surface temperature is lower than 650° C., the slab 10 is hardened due to a temperature drop and sufficient reduction becomes difficult regardless of the roll shape.

In determining the reduction position during the continuous casting, a position where the center solid phase rate is 0.8, a complete solidification position, and a reduction position optimal range limit position after the complete solidification can be respectively determined by combining the temperature measurement of the slab surface during the continuous casting with the heat transfer solidification calculation of the slab 10.

EXAMPLES

In a curved bloom continuous casting in which a bloom with a slab shape having a width of 550 mm and a thickness of 400 mm was cast, a test to which an example was applied were performed. At a casting speed of 0.4 m/min, the solidification completion position was a position with a casting length of 20 m. The pair of reduction rolls 1 in which an F-surface roll is a flat roll and an L-surface roll is the convex roll 3 were prepared, and performed reduction at a position with a casting length of 30 m. The reduction force was 100 tons.

As illustrated in FIG. 4, the related-art convex disc roll 5 has the horizontal portion 20 having a length of 200 mm at the width center position 13 and the inclined portions 21 having an angle of 17° via the corner portions 15 on both sides thereof. The roll radius of the horizontal portion 20 is larger by 20 mm than the roll radius of the flat roll portions at both ends of the width.

As the convex curved roll 4 of the example, as illustrated in FIG. 3, a roll having the circular arc shape 18 having a constant radius of 430 mm the convex shape defining range 14 (a range of a total length of 0.80×W on both sides in the roll width direction from the width center position 13) and having the roll radius $r_C$ at the width center position 13 of 60 mm larger than the reduction roll radius $r_E$ at both ends of the convex shape defining range 14 was used. The roll radius $r_C$ at the width center position 13 is 400 mm. The arc shape 18 within the convex shape defining range 14 continues to the outside of the convex shape defining range 14 (radius $R_1$ range 23), thereafter smoothly connected to the arc shape 19 (radius $R_2$ range 24) that is concave outward with the arc radius $R_2$=100 mm, and finally smoothly connected to the flat roll portion having the cylindrical shape 22 with the roll radius $r_F$ of 340 mm.

As mentioned above, the center porosity of the slab 10 was evaluated using the porosity area ratio calculated by the color check of the cross-section of the slab as an index. In the related-art example using the convex disc roll 5 as the reduction roll 1, the center porosity area ratio was 3% or more. In the example using the convex curved roll 4, the center porosity area ratio was 0.3%. In this way, the effect of decreasing the center porosity of the continuous cast slab according to the present embodiment was confirmed.

The slabs of the example and the related-art example were subjected to hot rolling as a general hot rolling process. As a result of comparing the product defect rates resulting from the surface shape of the slab with each other, the product defect rate was about 5% in the slab of the related-art example, but as a result of using the slab 10 of the example, the product defect rate was reduced to 0.5% or less. In this way, the effect of reducing the defects in the hot rolling according to the present embodiment was confirmed.

INDUSTRIAL APPLICABILITY

The continuous casting method for steel and the reduction roll for continuous casting according to the present invention can be used for the continuous casting of slabs used as raw materials for various steel products.

BRIEF DESCRIPTION OF THE REFERENCE SYMBOLS

1: reduction roll
2: reduction roll
3: convex roll
4: convex curved roll
5: convex disc roll
10: slab
11: roll outer peripheral shape
12: roll rotation axis
13: width-direction center position (width center position)
14: convex shape defining range
15: corner portion
16: curve
17: straight line
18: arc shape
19: arc shape
20: horizontal portion
21: inclined portion
22: cylindrical shape
23: radius $R_1$ range
24: radius $R_2$ range
31: chord
32: arc
W: slab width
$r_C$: reduction roll radius at width center position
$r_F$: reduction roll radius of width end
$r_E$: reduction roll radius of both ends of convex shape defining range
$R_1$: arc radius
$R_2$: arc radius
h: height of arc of arcuate shape
s: length of chord of arcuate shape
θ: half of central angle of arcuate shape
R: radius of arcuate shape

The invention claimed is:

1. A continuous casting method for steel, comprising:

providing a slab at a position at which a center solid phase ratio of the slab is 0.8 or more and which includes after complete solidification;

providing at least one pair of reduction rolls; and reducing the slab by the at least one pair of reduction rolls during continuous casting, wherein a slab width to be cast is defined as W (mm) and a slab thickness is defined as t (mm), wherein, in the pair of reduction rolls, one reduction roll on a lower side is a flat roll, and the other reduction roll on an upper side is a convex roll formed in a roll outer peripheral shape in a cross-section including a roll rotation axis has a convex shape overhanging outward in a region including a width-direction center position of the slab, wherein the convex shape is any one of a curved shape that is convex outward and has no corner portion or a shape that is a combination of a curve that is convex outward and a straight line with a length within 0.25×W and that has no corner portion, in a convex shape defining range of a total length of 0.80×W on both sides in a roll width direction from the width-direction center position, wherein a reduction roll radius at the width-direction center position is greater by 0.005×t or more than a reduction roll radius at both ends of the convex shape defining range, wherein the roll outer peripheral shape has a straight line parallel to the roll rotation axis at both ends in the width direction, and has a concave curve that is smoothly connected to the straight line, has an inflection point where a second-order differential value of a function defining the roll outer peripheral shape is 0, and the second-order differential value is continuous before and after the inflection point, and wherein the roll outer peripheral shape within the convex shape defining range forms an arcuate shape in which a length portion of the convex shape defining range is a chord.

2. The continuous casting method for steel according to claim 1, wherein a position of the slab in a casting direction in which the reduction is performed by the reduction roll is a position after the complete solidification.

3. The continuous casting method for steel according to claim 2, wherein a reduction amount of the slab by the pair of reduction rolls is 0.005×t or more and 15 mm or less at the width-direction center position.

4. The continuous casting method for steel according to claim 1, wherein a reduction amount of the slab by the pair of reduction rolls is 0.005×t or more and 15 mm or less at the width-direction center position.

5. The continuous casting method for steel according to claim 1, wherein the convex shape defining range of the reduction roll on the upper side and a straight portion of the reduction roll on the lower side face with each other.

6. A reduction roll for reducing a slab having a slab width: W (mm) and a slab thickness: t (mm) during continuous casting, wherein a roll outer peripheral shape in a cross-section including a roll rotation axis has a convex shape overhanging outward in a region including a width-direction center position of the slab, wherein the convex shape is any one of a curved shape that is convex outward and has no corner portion or a shape that is a combination of a curve that is convex outward and a straight line with a length within 0.25×W and that has no corner portion, in a convex shape defining range of a distance of 0.80×W on both sides in a roll width direction from the width-direction center position, wherein a reduction roll radius at the width-direction center position is greater by 0.005×t or more than a reduction roll radius at both ends of the convex shape defining range, and wherein the roll outer peripheral shape has a straight line parallel to the roll rotation axis at both ends in the width direction, and has a concave curve that is smoothly connected to the straight line, has an inflection point where a second-order differential value of a function defining the roll outer peripheral shape is 0, and the second-order differential value is continuous before and after the inflection point, and wherein the roll outer peripheral shape within the convex shape defining range forms an arcuate shape in which a length portion of the convex shape defining range is a chord.

* * * * *